US007426803B2

(12) United States Patent
Fronz et al.

(10) Patent No.: US 7,426,803 B2
(45) Date of Patent: Sep. 23, 2008

(54) SWINGING AND SLIDING DOOR FOR RAIL VEHICLES

(75) Inventors: Reinhard Fronz, Dessau (DE); Holger Lenkeit, Dessau (DE); Wolfgang Steiniger, Geesthacht (DE)

(73) Assignee: Fahrzeugtechnik Dessau AG, Dessau (DE)

( * ) Notice: Subject to any disclaimer, the term of this patent is extended or adjusted under 35 U.S.C. 154(b) by 587 days.

(21) Appl. No.: 10/987,724

(22) Filed: Nov. 12, 2004

(65) Prior Publication Data

US 2005/0235564 A1 Oct. 27, 2005

(30) Foreign Application Priority Data

Apr. 10, 2004 (EP) ..... 04008686

(51) Int. Cl.
*E05D 15/10* (2006.01)

(52) U.S. Cl. ..... 49/209; 49/213; 49/215; 49/218

(58) Field of Classification Search ..... 49/209, 49/210, 213, 215, 216, 218, 219, 220, 221, 49/223, 207

See application file for complete search history.

(56) References Cited

U.S. PATENT DOCUMENTS

| | | | | |
|---|---|---|---|---|
| 4,543,746 A | | 10/1985 | Racca | |
| 4,704,819 A | * | 11/1987 | Tutikawa | 49/129 |
| 5,142,823 A | * | 9/1992 | Brandenburg et al. | 49/118 |
| 5,263,280 A | * | 11/1993 | Dilcher | 49/212 |
| 5,483,769 A | * | 1/1996 | Zweili | 49/118 |
| 6,385,910 B1 | * | 5/2002 | Smink et al. | 49/218 |
| 7,008,514 B2 | * | 3/2006 | Matsumura et al. | 196/155 |
| 2004/0123524 A1 | * | 7/2004 | Batinli et al. | 49/216 |

FOREIGN PATENT DOCUMENTS

| | | |
|---|---|---|
| DE | 43 16 253 A1 | 11/1994 |
| DE | 101 16 583 A1 | 10/2002 |
| EP | 0 875 434 A1 | 11/1998 |

* cited by examiner

*Primary Examiner*—Gregory J. Strimbu
(74) *Attorney, Agent, or Firm*—Laurence A. Greenberg; Werner H. Stemer; Ralph E. Locher

(57) ABSTRACT

An angular lever for guiding and moving a door leaf is rotatably mounted in a horizontal plane in the direct vicinity of the door frame. One limb of the angular lever is permanently connected to a guide rail of the door leaf, and the other limb temporarily engages with a control element on a guide unit to swing the door leaf. In order to open completely and subsequently close the door leaf, a guide arm of the door leaf is operatively connected to the control element. During the closing movement of the door leaf, an operative connection of the guide arm to the control element is released and the other limb of the angular lever engages again with the control element. When the angular lever assumes its home position, it presses the door leaf firmly against a door seal and locks the door leaf.

17 Claims, 10 Drawing Sheets

SWINGING AND SLIDING DOOR FOR RAIL VEHICLES

BACKGROUND OF THE INVENTION

Field of the Invention

The invention relates to a swinging sliding door for rail vehicles having at least one door leaf which can be displaced in its longitudinal direction. The door leaf is horizontally guided in the upper region in a guide that is attached in a stationary fashion and has a straight section and a section that is curved inwards in the direction of the door frame and is connected to a guide arm that is attached to the door leaf. The door assembly further has a guide rail which is arranged on the door leaf and to which means for moving the door leaf are coupled in the transverse direction, and a drive which has the purpose of moving the door leaf into a position extending parallel to the outer wall of the vehicle and is equipped with a linearly movable guide unit on which the guide arm engages.

Swinging sliding doors for rail vehicles are already known in various embodiment variants. All the known swinging sliding doors have in common the fact that they are moved by a transverse or swinging movement out of the closed position into a position in which they are ready for opening, and are subsequently moved parallel to the outer wall of the vehicle into a position which clears the door opening.

German published patent application DE 43 16 253 A1 discloses a device of the generic type moving a swinging sliding door for rail vehicles. The arrangement of a parallelogram linkage for displacing the door leaf is costly and requires a relatively large installation space. The housing of the drive must therefore be rotatably mounted so that a torque is also additionally generated by the reaction force. Owing to the predefined movement sequence, the door leaf is moved with a high level of kinetic energy into the final closed position. This has considerable disadvantages in terms of safety since, owing to the high clamping forces, there is the risk of pinching injuries to persons when they climb in and out as the door closes and that the reversing of the door leaves is initiated too late.

Commonly assigned German published patent application DE 101 16 583 A1 discloses a swinging sliding door for rail vehicles having at least one door leaf and a device for locking and unlocking the door leaf. The door leaf is horizontally guided in the upper region in a guide which is attached to the wagon body in a stationary fashion and has a section which is curved at the start and subsequently straight. In order to carry out the transverse and longitudinal displacement of the door leaf, a drive element which is embodied as a toothed rack is arranged on it, the drive element being positively engaged with a slewing gear which is mounted on the shaft and is driven by a stationary drive motor.

That solution is very costly, in particular for two-wing swinging sliding doors.

SUMMARY OF THE INVENTION

It is accordingly an object of the invention to provide a swinging sliding door for a rail vehicles which overcomes the above-mentioned disadvantages of the heretofore-known devices and methods of this general type and which provides for a swinging sliding door having at least one door leaf which can be displaced in its longitudinal direction and which is distinguished by a low degree of expenditure on manufacture and mounting, as well as by an improved opening and closing mechanism.

With the foregoing and other objects in view there is provided, in accordance with the invention, a swinging sliding door assembly for a rail vehicle, comprising:

a guide stationarily mounted to the rail vehicle, the guide having a straight section and an inwardly curved section curved in a direction toward a door frame of the rail vehicle;

at least one door leaf horizontally guided in an upper region thereof in the guide;

a guide arm attached to the door leaf and operatively connected to the guide;

a guide rail disposed on the door leaf and means coupled to the guide rail for moving the door leaf in a transverse direction;

a drive for moving the door leaf into a position extending parallel to an outer wall of the vehicle, the drive including a linearly movable guide unit on which the guide arm engages;

an angular lever for guiding and moving the door leaf rotatably mounted in a substantially horizontal plane in the transverse direction in an immediate vicinity of the door frame, the angular lever having a first limb permanently connected with the guide rail of the door leaf, and a second, inwardly pointing limb temporarily engaging with, and operatively connected to, a control element disposed on the guide unit for displacing the door leaf transversely, and disengaging after a defined transverse displacement of the door leaf; and wherein, for controlling a further movement sequence to fully open and subsequently close the door leaf, the guide arm is operatively connected to the control element, and during a closing movement of the door leaf, after the door leaf runs into a door opening, an operative connection of the guide arm with the control element is released and the second, inwardly pointing limb of the angular lever once more engages with, and connects operatively to, the control element, and upon a further closing movement of the door leaf the angular lever assumes a home position and thereby firmly presses the door leaf against a door seal and locks the door leaf.

In order to guide and move the door leaf of the swinging sliding door, an angular lever is rotatably mounted in a horizontal plane in the direct vicinity of the door frame, in the region of the side on which the closing edge is located. In the case of a two-wing swinging sliding door there is in each case an angular lever in the region of the vertical longitudinal sides. The angular levers are preferably connected to the vertical rotary columns or the doorposts.

The angular lever has two limbs which are arranged at an angle of 90° to 120° as a function of the installation space available.

One limb of the angular lever which in the installation position points outwards in the direction of the door leaf is continuously connected to the guide rail of the door leaf. The other, inwardly pointing limb of the angular lever is used to displace the door leaf transversely out of the door opening, and temporarily engages with, and is operatively connected to, a control element which is arranged on the linearly movable guide unit. After a defined transverse displacement of the door leaf (end of phase I), this limb disengages again. In order to control the further movement sequence for completely opening and subsequently closing the door leaf (phase II), the guide arm is operatively connected to the control element. During the closing movement of the door leaf, after it has run into the door opening, the operative connection between the guide arm and the control element is released again. At the same time, the inwardly pointing limb of the angular lever engages again with, and is operatively connected to, the control element. Owing to the further closing movement of the door leaf, the angular lever is moved back again into its home position, and in the process presses the door leaf firmly against the door seal and locks it.

This solution principle which can be used for different door systems, both single-leaf and two-leaf ones, permits a closing movement of the door or door leaves with regulated kinematics as well as a small amount of kinetic energy. It is particularly advantageous that after it runs into the door opening the door is automatically pulled firmly against the door seal by the swinging movement of the angular lever, without additional locking means. The locking in the final locked position which is usually still necessary can be carried out using significantly simpler and more cost-effective means. The proposed solution takes up only a small installation space and the components which are required to implement the necessary kinematics are comparatively cost-effective. Owing to the relatively small number of components, the expenditure on mounting is reduced. The components which are necessary for the kinematics are arranged in a clearly organized way and permit good accessibility for repair and maintenance work. When the door leaves are opened to the maximum width, the drive means and control means do not project beyond the predefined opening in the shell in the horizontal direction. This makes it possible to mount the swinging sliding door as a fully functional component in a prefabricated door module which, in the course of the manufacture of the vehicle, is inserted into the prepared opening in the shell of the vehicle body and attached.

The control element which is arranged on the linearly movable guide unit is embodied as a plate-shaped component which points in the direction of the door leaf. Two embodiment variants are provided as control plates. In one variant, the control plate has a fork-shaped guide, bent into the shape of an L, as control cam. The associated guide arm and the inwardly pointing limb of the angular lever engage in this cam, the guide arm being mounted in a floating and displaceable fashion in the fork-shaped guide during the operative connection between the limb and the control plate.

According to the other variant, the control plate is equipped with two separate guides, a first guide for the inwardly pointing limb, which guide is arranged as a semicircular opening at the front end, and a second guide for the associated guide arm, which guide is arranged adjacent to the first and is embodied as a recess which extends from the front to the rear end. The recess has, in the rear region, an enlarged section and a curved path which adjoins said section and extends toward the front, the guide arm being mounted in a floating and displaceable fashion within the enlarged section and being connected in a positively and frictionally locking fashion to the control plate when it is placed in contact with the curved path.

There is in each case an upwardly directed guide roller at the free end of the guide arm and at the free end of the inwardly directed limb, which rollers project into the corresponding openings and guides of the control element. The guide rollers lie a plane.

The linearly movable guide unit is preferably embodied as a guide bush which is guided on a guide rod. A suitable roller guide with roller carriages can also be used as a guide unit. The control element or the control plate is attached to the underside of the guide unit.

The guide rail which is attached to the door leaf has an outwardly curved section at the end pointing to the door frame. The limb of the angular lever which points to the door leaf is connected to said guide rail via guide rollers and support rollers, one guide roller bearing against the inside and the other guide roller against the outside of the guide rail. The guide rollers point upwards and are mounted in vertical axes of rotation. The support roller bears against the underside of the guide rail, between the two guide rollers.

During the transverse displacement of the door leaf, the guide rollers lie in the radius of the curved section of the guide rail.

In the lower region of the door leaf a further guide rail is arranged at a distance from it, said guide rail also having an outwardly curved section at the end pointing to the door frame and being connected by means of guide rollers to a pivoted lever which is mounted on the same axis as the angular lever and is operatively connected to it synchronously.

In certain applications it may be necessary, if, after the swinging, the angular lever assumes a position in which the center axis x of the limb which points to the door leaf extends virtually at right angles to the longitudinal axis of the vehicle, to lock said limb in this position during the longitudinal displacement of the door leaf parallel to the outer wall of the vehicle, and to release the lock again during the closing movement. For this purpose there is provision to mount in a rotatable manner a spring-loaded two-armed locking lever on the lower side or upper side of the limb of the angular lever which points in the direction of the door leaf, the inwardly directed lever arm of which locking lever moves into contact, during the swinging movement of the angular lever as the door leaf opens, with a stop which is arranged in a stationary fashion, and said lever arm locks the locking lever and as a result locks the angular lever.

In order to release the lock, a driver is arranged on the door leaf, which driver engages or impacts on the outwardly directed lever arm of the locking lever during the closing movement of the door leaf, and disengages the lever arm from the stop.

In the embodiment of the solution according to the invention for a two-wing swinging sliding door it has proven advantageous to arrange the guide arms so that they cross over one another. In this case, two opposed guide units, a right-hand one and a left-hand one, are provided, and these are guided on a common linear guide, for example a guide rod. During the synchronous movements of the door leaves, the right-hand door leaf engages with, or is connected to, the left-hand roller carriage and the left-hand guide unit via the associated guide arm and guide roller, and the left-hand door leaf engages with, or is connected to, the right-hand roller carriage and the right-hand guide unit via the guide arm and guide roller.

Once more in summary, the invention relates to a swinging sliding door for rail vehicles. Taking the disadvantages of the known prior art as a starting point, a swinging sliding door is to be provided which is distinguished by a low degree of expenditure on manufacture and mounting as well as by an improved opening and closing mechanism.

As a solution to this, it is proposed that an angular lever for guiding and moving the door leaf be rotatably mounted in a horizontal plane in the transverse direction in the direct vicinity of the door frame, wherein one of the limbs of the angular lever is continuously connected to the guide rail of the door leaf, and the other, inwardly pointing limb of the angular lever temporarily engages with, and is operatively connected to, a control element arranged on the guide unit in order to displace the door leaf transversely, and is disengaged again after a defined transverse displacement of the door leaf. In order to control the further movement sequence in order to open completely and subsequently close the door leaf, the guide arm is operatively connected to the control element. During the closing movement of the door leaf after the door leaf has run into the door opening, the operative connection of the guide arm to the control arm is released again and at the same time the inwardly pointing limb of the angular lever engages again with, and is operatively connected to, the control element. As a result of the further closing movement of the door leaf, the angular lever assumes its home position again and in the process presses the door leaf firmly against the door seal and locks the door leaf This solution permits a closing movement of the door or door leaves with regulated kinematics as well as a low level of kinetic energy. It is particularly advantageous that after running into the door opening the door is automatically pulled firmly against the door seal by the swinging movement of the angular lever, without additional locking means.

Other features which are considered as characteristic for the invention are set forth in the appended claims.

Although the invention is illustrated and described herein as embodied in a swinging sliding door for rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
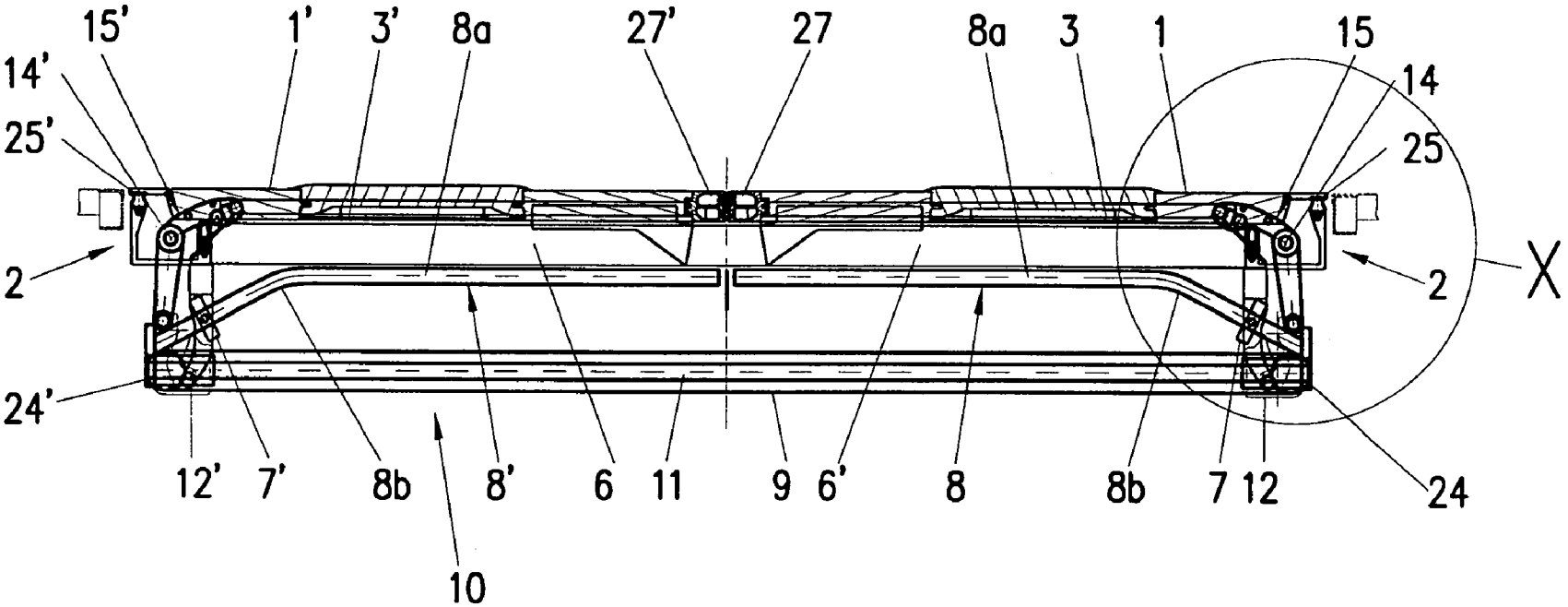
FIG. 1 is a plan view of a two-wing swinging sliding door in the installed and closed state.
Figure 2:
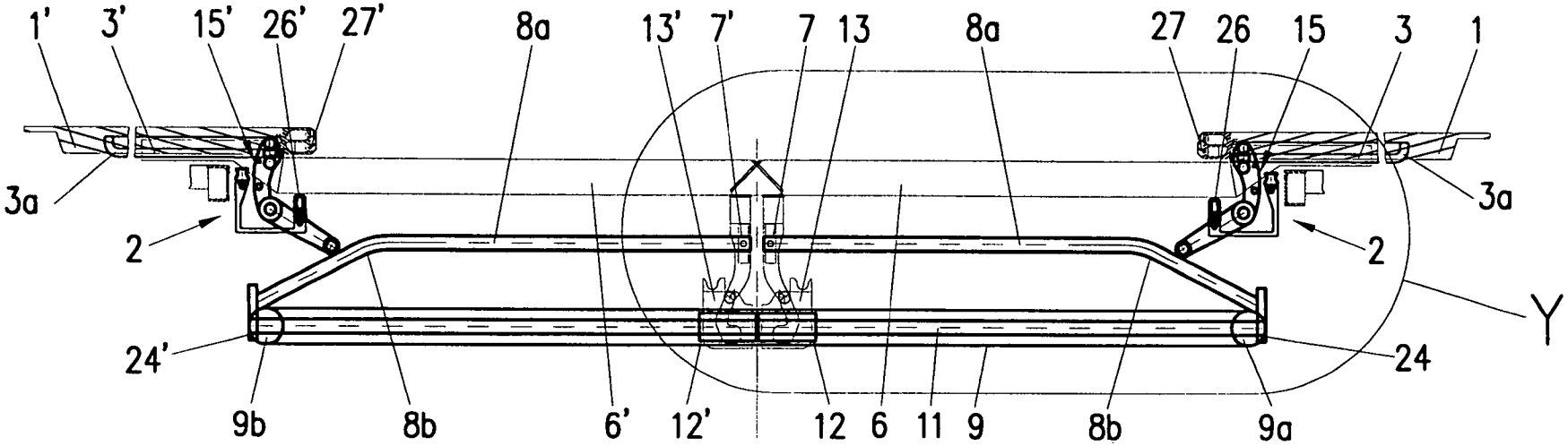
FIG. 2 shows the swinging sliding door assembly according to FIG. 1 in the opened state of the door leaves.
Figure 3:
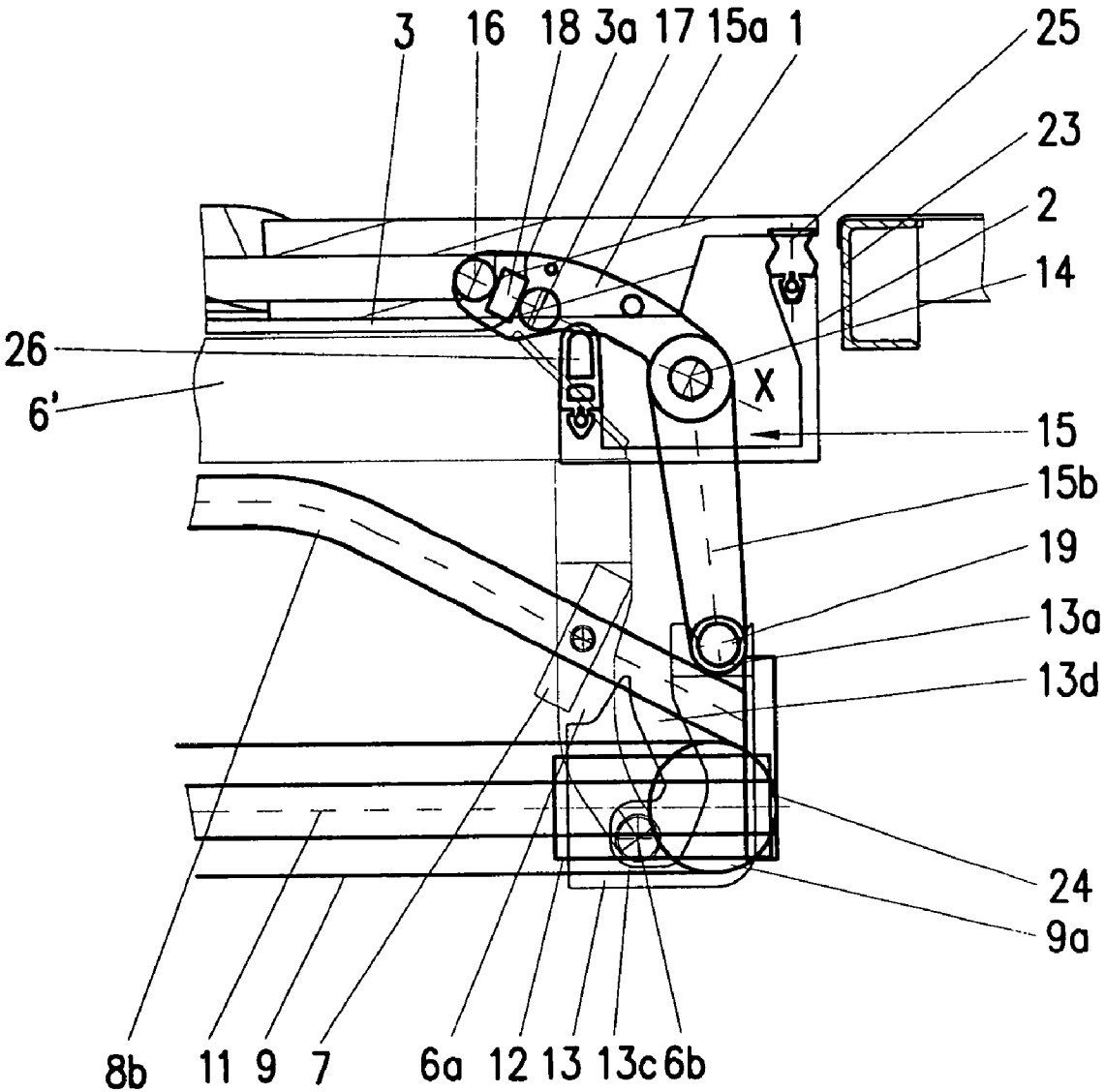
FIG. 3 shows the detail "X" according to FIG. 1 in an enlarged view.
Figure 4:
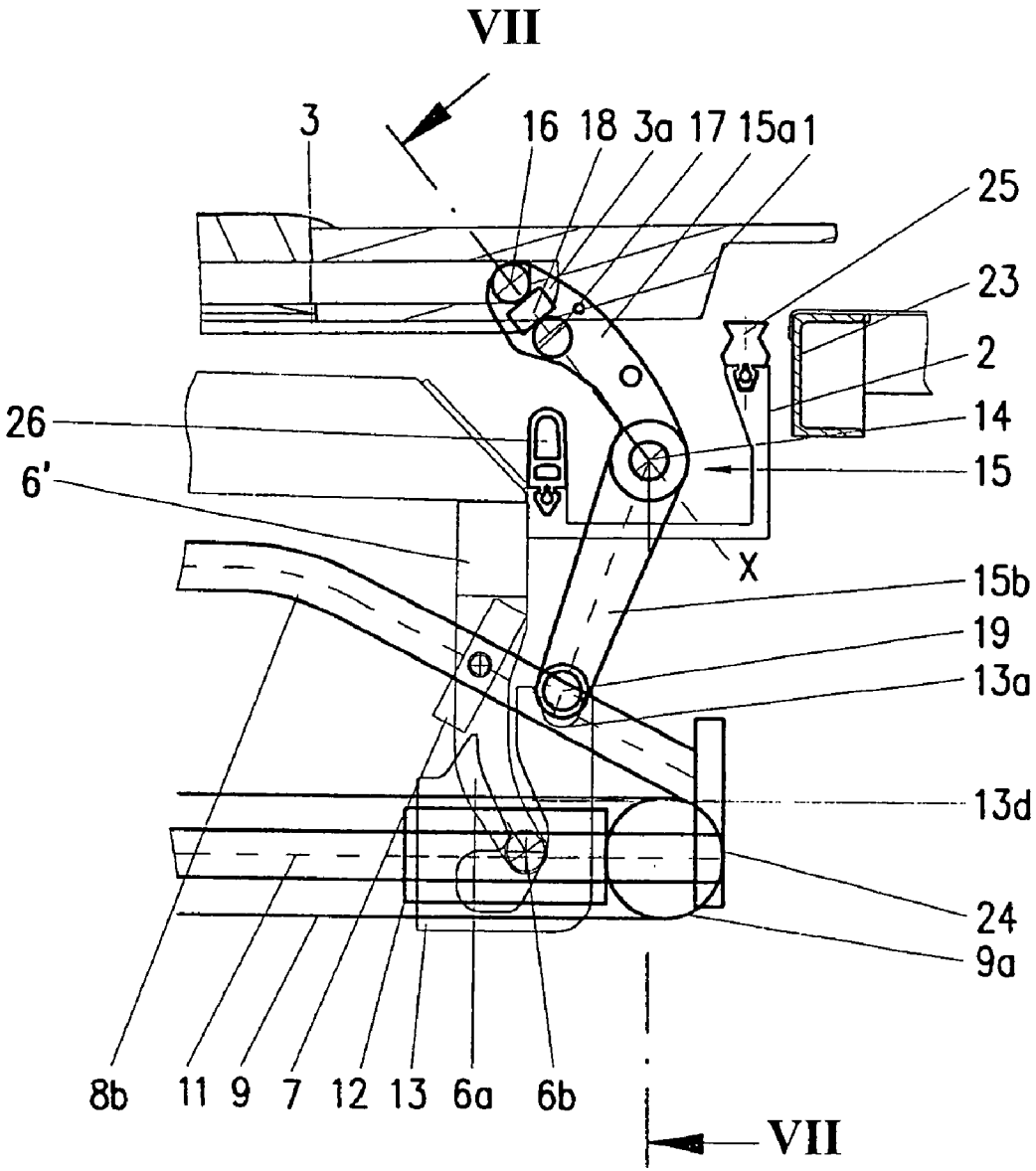
FIG. 4 shows the detail "X" according to FIG. 1 with the door leaves partially opened in the "transfer position;"

Referring now to the figures of the drawing in detail and first, particularly, to FIG. 1 thereof, the swinging sliding door which closes the door opening is composed of two door leaves 1 and 1', the outsides of which form a plane with the outer wall of the vehicle in the closed state. On the insides of the door leaves 1 and 1', guide rails 3 and 3' are attached spaced apart in the upper region, and guide rails 4 (FIG. 7) are attached spaced apart in the lower region, said guide rails extending parallel to the inside of the door leaves 1, 1' and having, at the end pointing respectively in the direction of the door frame 2, an outwardly curved section 3*a* (FIGS. 2 and 4). The door leaves 1 and 1' are attached in the upper region to guide arms 6 and 6' which are connected to roller carriages 7, 7' which are each guided in a roller guide 8, 8'. The guide arms 6, 6' are arranged so as to cross over one another and have an inwardly directed, bent extension section 6*a* with an upwardly directed guide roller 6*b* (FIG. 3). The roller guides 8 and 8' have straight sections 8*a* which extend parallel to the wagon body, and sections 8*b* which are curved or bent in the direction of the inside of the wagon. The curved sections 8*b* are each located on the end pointing in the direction of the door frame 2. The necessary movement force for displacing the door leaves 1, 1' transversely and longitudinally is provided by means of a d.c. motor 5 which activates, via an intermediately connected gear mechanism, a linear drive 10 which is composed of a linear guide 11 and a toothed belt 9 which is guided between two rollers 9*a* and 9*b*, the roller 9*a* forming the drive roller.

Figure 8:
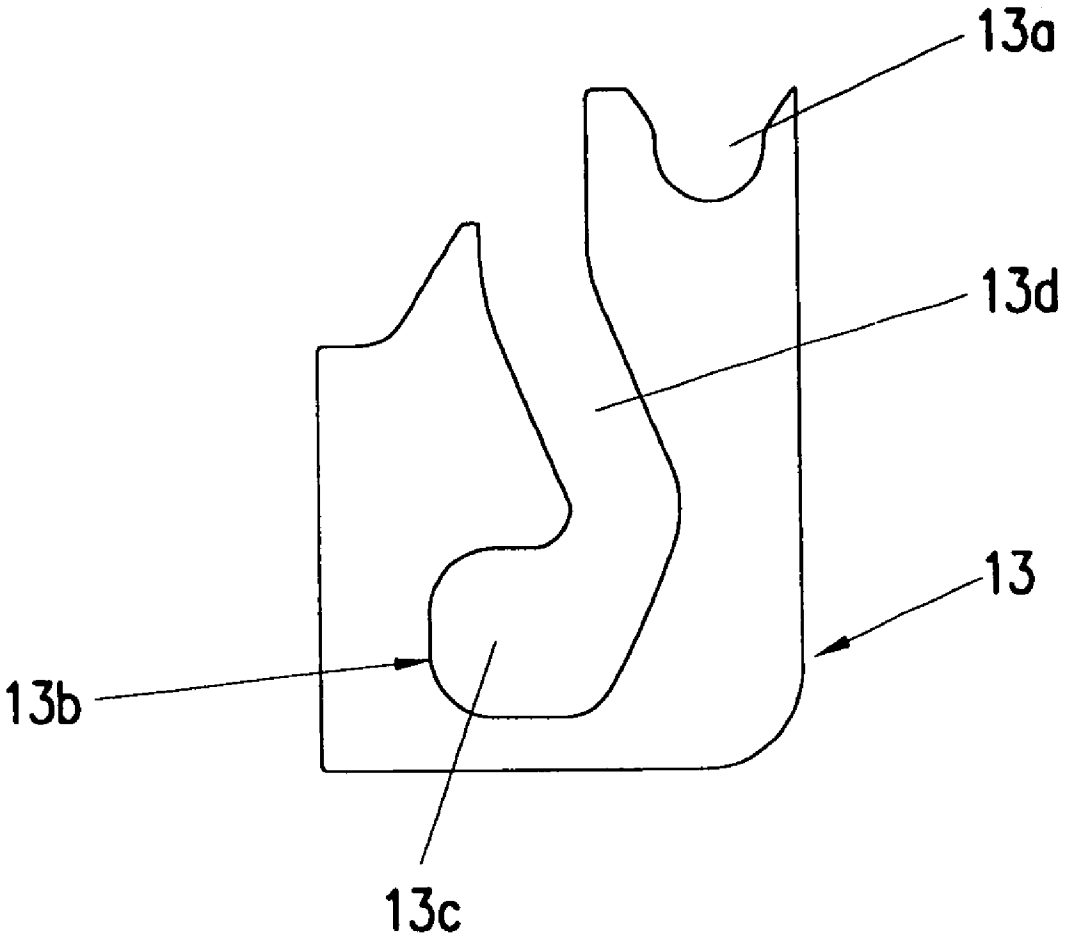
FIG. 8 shows the control plate, shown in FIGS. 1 to 7, as a detail in a plan view.

On the guide rod 11 which is embodied as a linear guide, two guide bushes 12 and 12' are guided in a longitudinally movable fashion as guide units and are each connected to one of the strands of the toothed belt 9. In the closed state of the door leaves 1, 1', the guide bushes 12, 12' are each located at the outer end of the guide rod 11, in contact with the stops 24, 24' (FIG. 1). The opening and closing movements of the door leaves 1 and 1' take place synchronously. In order to control the movement sequence, a control element 13 or 13' is attached in each case to the guide bushes 12 and 12', said control elements 13 and 13' being embodied as identical, plate-shaped components. The arrangement and design of the control plates 13, 13' is apparent in particular from FIGS. 5, 6 and 8. The control plates 13, 13' are attached to the underside of the guide bushes 12, 12' and point in the direction of the door leaf, 1, 1'. Each control plate has a semicircular opening 13*a* in the front section, and a recess 13*b* adjacent to said opening 13*a*. The recess 13*b* is formed by an enlarged section 13*c* and a curved path 13*d* which adjoins the latter and extends as far as the front end of the control plate 13, 13'. Further details of the significance and function of the control elements 13, 13' will be given below.

Figure 6:
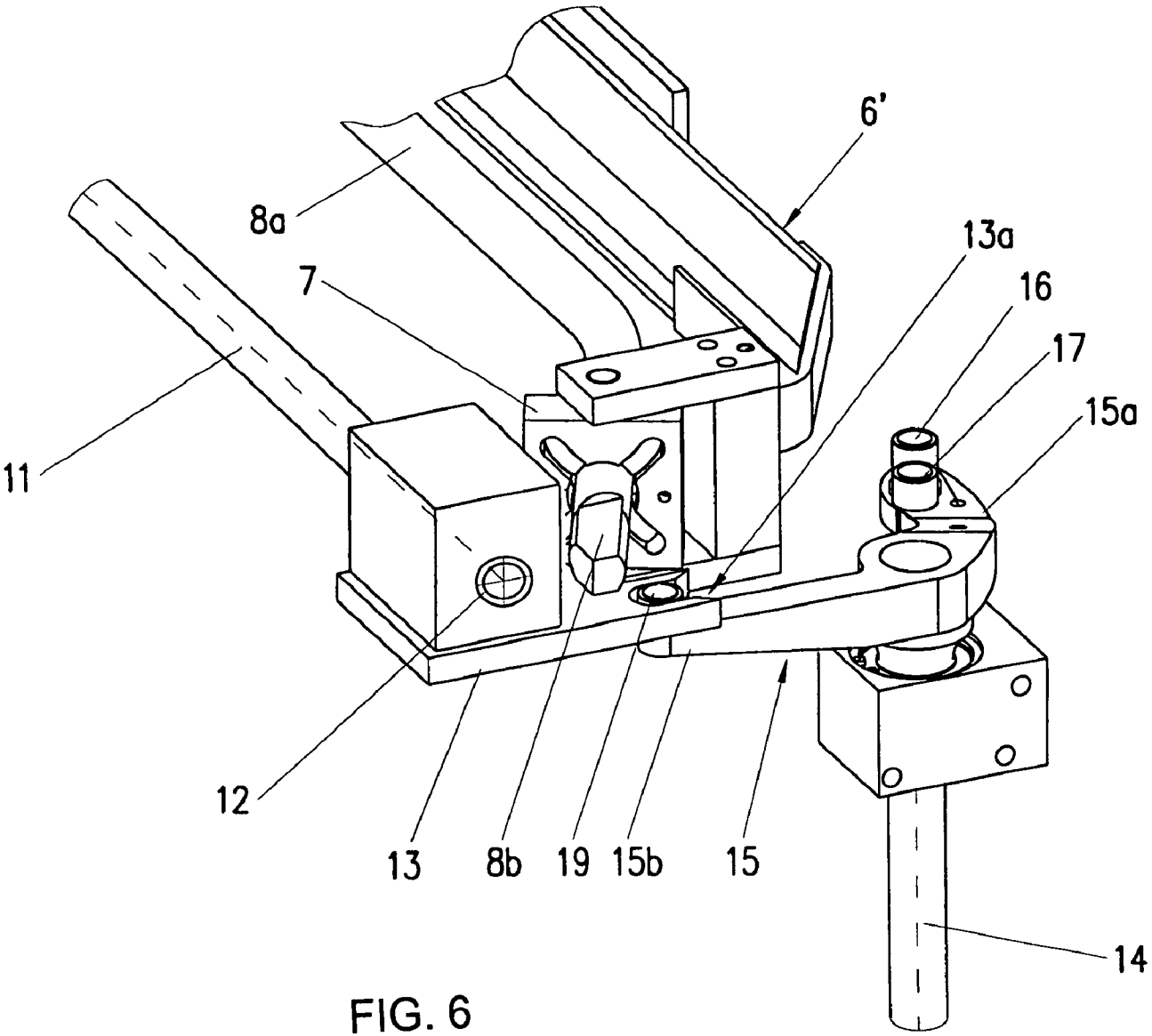
FIG. 6 shows the individual parts of the guide bush with the control element, guide arm and angular lever, in a perspective view.

The movement sequence of the door leaves is divided into two phases I and II. During phase I, the pressing out of the door leaves 1, 1' from the door opening into a slightly oblique position, the control plate 13, 13*a* which is attached to the guide bush 12 is responsible for controlling the movement sequence of the door leaf 1, and accordingly the guide bush 12' and control plate 13', 13*a* are responsible for the door leaf 1'. The guide roller 19 of the respective limb 15*b* of the angular lever 15, 15' engages with the semicircular opening 13*a* of the control plate 13 or 13', as shown in FIGS. 3 and 6.

During phase II, the further transverse and longitudinal displacement of the door leaves 1, 1' by means of the roller carriages 7, 7', the guide bush 12 with the control plate 13, 13*d* is responsible for the door leaf 1', and the guide bush 12' with the control plate 13', 13*d* is responsible for the door leaf 1. Due to the crossing over or overlapping arrangement of the guide arms 6, 6', the roller 6*b* of the guide arm 6 to which the door leaf 1 is attached is in contact with the control cam 13*d* of the control plate 13', and the roller 6*b* of the guide arm 6' is in contact, in an analogous fashion, with the control plate 13. The guide arm 6 is connected to the roller carriage 7', and the guide arm 6' is connected to the roller carriage 7, as shown in FIG. 2.

The movement sequences of the two phases I and II are matched to one another in such a way that kinematic over-specification during the changeover from phase I to phase II, or vice versa, is prevented.

Identical angular levers 15, 15' are attached in the upper region to the vertical rotary columns 14, 14' which are arranged in the vicinity of the door frame. The angular levers 15, 15' have two limbs 15*a* (first) and 15*b* (second) which are arranged at an angle of 90° to 120°. The size of the angle is dependent on the available installation space. The apex point of the limbs 15*a*, 15*b* forms the axis of rotation which lies in the center axis of the rotary column 14, 14'. The first limb 15*a* which points in the direction of the door leaf 1, 1' has, at its front end, upwardly pointing guide rollers 16 and 17 which are mounted in vertical axes of rotation, and a lower support roller 18, which guide rollers 16 and 17 and support roller 18 bear against the upper guide rail 3 or 3' which is attached to the door leaf 1, 1' (FIG. 3). The support roller 18 performs an axle function during the movement of the door leaves 1, 1' and a support function for the drive forces which occur. The second, inwardly directed limb 15*b* has, at its free end, a guide roller 19 which is mounted in a vertical axis of rotation and which points upwards and in the closed state of the door leaves 1, 1' engages with the semicircular guide 13*a* of the respective control element 13, 13' (FIGS. 3 and 6). The guide arms 6, 6' which are connected to the roller carriages 7, 7' have, at their end 6*a* protruding from the door leaf 1, 1', an upwardly directed guide roller 6*b*. This projects, in the closed state of the door leaves 1, 1', into the enlarged section 13*c* of the recess 13*b* of the respective control plate 13 or 13' and is mounted so as to be freely movable, that is to say floating, in it during the movement phase I of the door leaves 1, 1'. Due to an expansion of the toothed belt 9, it may be necessary to limit the movement play of the guide roller 6*b* within the opening 13*c* in the longitudinal direction by means of a stop in order to form a mechanical short circuit.

The guide roller 6*b* does not engage with the curved path 13*d* until after a defined transverse displacement of the door leaves 1, 1', constituting the ending of phase I, and phase II begins. The movement sequence of the angular levers 15, 15' whose swinging movement is matched kinematically to the movement of the guide arms 6, 6' in such a way that, precisely when the guide roller 19 of the limb 15*b* disengages from the semicircular guide 13*a* (end of phase I), the guide rollers 6*b* engage with the curved path 13*d* of the control plates 13, 13' (start of phase II), and vice versa, during the closing movement of the door leaves 1, 1'. The guide rollers 6*b* and 19 lie in one plane.

Figure 7:
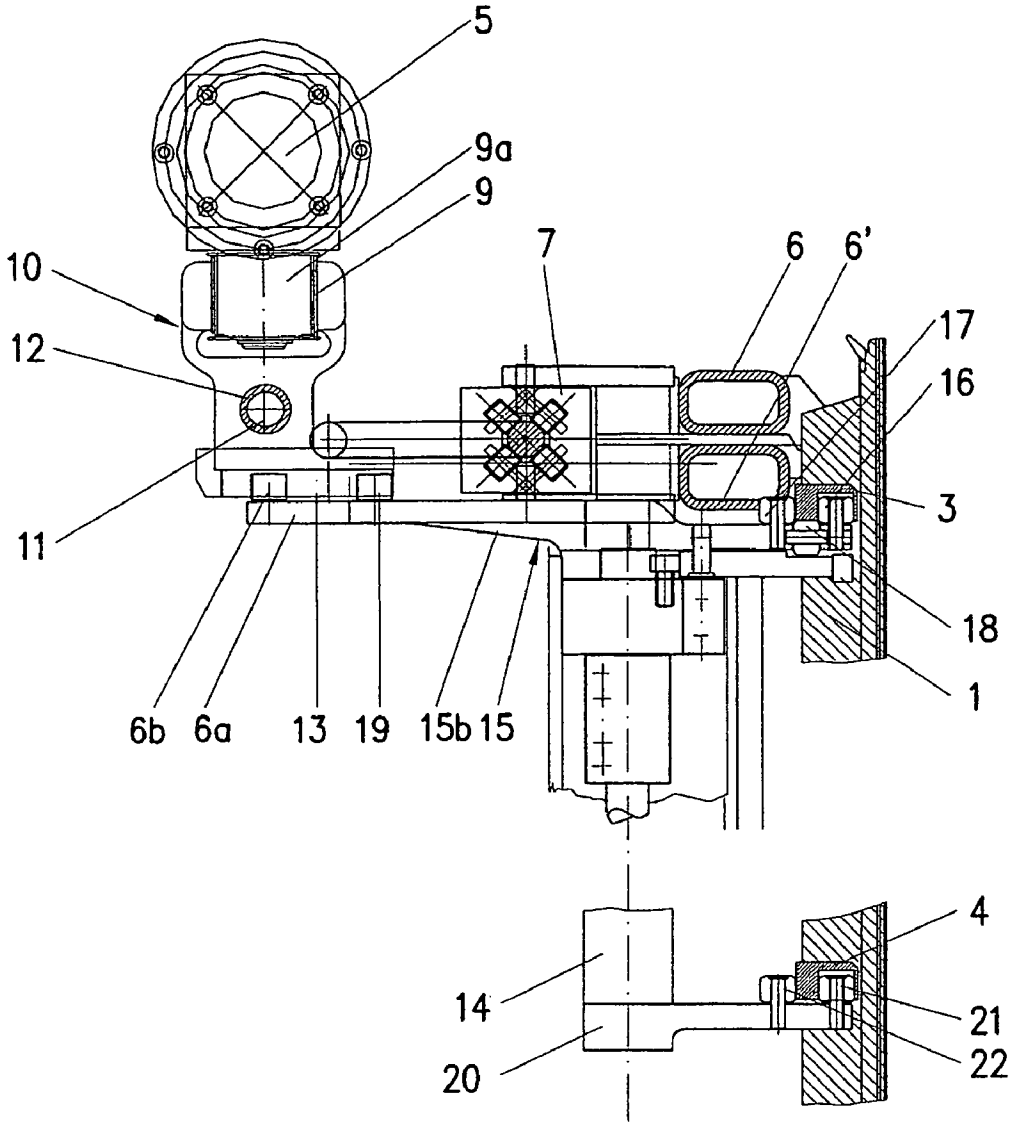
FIG. 7 shows a section taken along the line VII-VII in FIG. 4.

In the lower region of the two rotary columns 14, 14', a pivoted lever 20 is attached to them, the lever arm of which lever is of analogous construction to that of the limb 15*a* of the angular lever 15, 15', but without support rollers. The guide rollers 21, 22 engage around the lower guide rails 4 of the door leaves 1, 1' (FIG. 7). The movement of the angular levers 15, 15' is transmitted synchronously to the lower pivoted levers 20 via the rotary columns 14, 14'.

Figure 9:
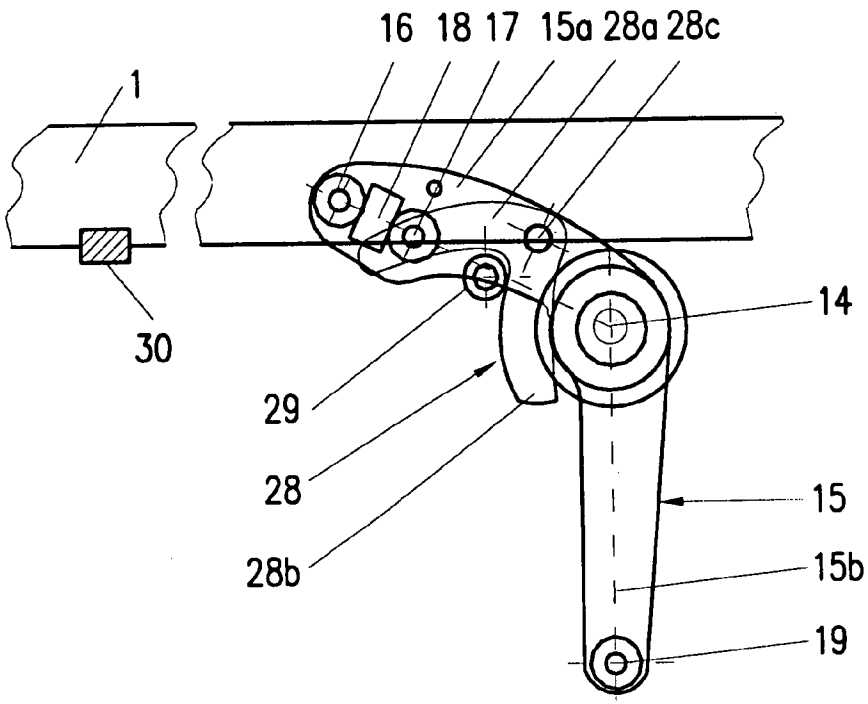
FIG. 9 shows an embodiment variant for locking the angular lever in a plan view.

In order to ensure that the door leaves 1, 1' are guided in a stable and precise fashion during the movement phase II, in particular during the longitudinal displacement of the door leaves 1, 1', parallel to the outer wall of the vehicle, it is expedient to lock the angular lever 15 or 15' when the latter assumes a position in which the center axis x of the limb 15*a* extends virtually at right angles to the longitudinal axis of the vehicle. An embodiment variant for locking and unlocking the angular levers is illustrated in FIGS. 9 and 10.

In order to lock the angular levers 15, 15', a spring-loaded, two-armed locking lever 28 is rotatably mounted on the underside of the limb 15*a* and is embodied as a relatively small angular lever. An upwardly pointing stop roller 29 is arranged on the bearing block for the angular lever 15 at a defined radial distance from the pivot point 28*c* of the locking lever 28. In the closed state of the door leaves 1, 1', the stop roller 29 bears against the inner curvature radius of the locking lever 28, as is shown in FIG. 9. During the opening movement of the door leaves 1, 1', the locking lever 28 swings synchronously with the angular lever 15 or 15' since it is entrained by it. If the angular lever 15, 15' reaches a position in which the center axis x of the limb 15*a* extends virtually at right angles to the longitudinal axis of the vehicle, the inwardly directed lever arm 28*b* of the locking lever 28 moves into contact with the stop roller 29 and locks the angular lever 15, 15'.

Figure 10:
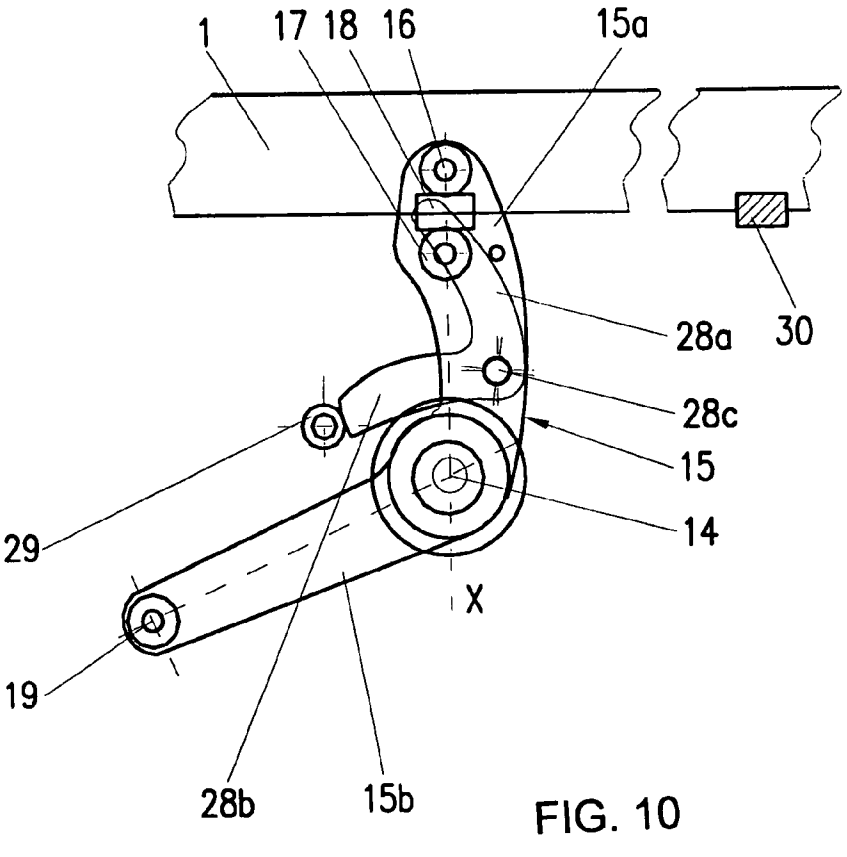
FIG. 10 shows the embodiment variant according to FIG. 9 in a locked position.

During the closing movement of the door leaves 1, 1', the locking of the angular levers 15, 15' is released by means of a driver 30 which is arranged on the inside of the door leaves 1, 1' and engages on the outwardly directed lever arm 28*a* (FIG. 10). As is shown in FIG. 1, the outsides of the door leaves 1, 1' form, in the closed state, one plane with the outside wall of the vehicle. The door leaves 1, 1' are held in a locked position by means of locking elements which are known per se. In the closed state of the door leaves 1, 1', the roller carriages 7 and 7' are located in the region of the curved sections 8*b* of the roller guides 8, 8', at a defined distance from the end of the curved sections 8*b*. The two linearly movable guide bushes 12, 12' which are guided on the guide rod 11 and which have control elements 13, 13' are in the home position, at the left-hand or right-hand end of the guide rod 11, bounded respectively by a stop 24, 24'. The guide rollers 19 of the limbs 15*b* of the angular levers 15 and 15' engage here with the semicircular guide 13*a* of the respective control element 13, 13' and are in contact with the arcuate section of this guide 13*a*.

In this home state of the angular levers 15 and 15', the guide rollers 16, 17 of the limbs 15*a* lie in the radius of the curved section 3*a* of the upper guide rails 3, 3'. This also applies analogously to the lower guide rollers 21, 22 which bear against the curved section of the pivoted lever 20. When the instruction "open door" is triggered, the door leaves 1, 1' are unlocked in the region of the vertical locking edges 23 and are made to move by means of the motor 5 and the gear mechanisms of the toothed belts 9 which are tensioned between the rollers 9*a*, 9*b*.

At the start of the opening movement, the guide roller 16 lies in the radius of the curved section 3*a*, and the opposite guide roller 17 bears against the outer circumference of this section 3*a*. The guide rollers 16 and 21 form the defined pivot point for the swinging movement of the door leaves 1, 1'. The movement of the guide bushes 12, 12' with the control elements 13, 13'—triggered by the opening movement—in the direction of the center of the door opening (phase I) brings about a swinging movement of the angular levers 15 and 15' about their axes 14, 14' of rotation as a result of the guide roller 19 of the limb 15*b* engaging in the semicircular guide 13*a* of the respective control element 13, 13', and the door leaves 1, 1' are as a result pushed out of the door opening synchronously in the transverse direction, into a slightly oblique position. The angular lever 15 which is located in the region of the left-hand side of the door frame is moved in the clockwise direction, and the angular lever 15' which is arranged on the opposite, right-hand side is moved in the counterclockwise direction (viewed from a position in front of the vehicle). As the guide bushes 12, 12' continue to move, the guide roller 19 of the limb 15*b*, which roller moves on an arcuate path, moves out of contact with the bent section of the semicircular guide 13*a*, as is shown in FIG. 4. At the same time, the guide rollers 6*b* which are arranged on the respective guide arms 6, 6' engage with the curved path 13*d* of the control plates 13, 13'. There is what is referred to as a "flying transfer" from phase I to phase II, and the linearly moveable guide bush 12, 12' is continuously connected by means of the control plate 13, 13', either to the angular lever 15, 15' (phase I) or to the guide arm 6, 6' (phase II). When the positively and frictionally locking connection comes about between the guide arms 6 and 6' and the control plates 13 and 13' of the linearly moved guide bushes 12 and 12', the roller carriages 7 and 7' are moved along the bent section 8*b* of the roller guides 8 and 8'. Owing to this movement, the door leaves 1, 1' are moved further in the transverse direction, into a position which extends obliquely with respect to the outer wall of the vehicle, and the guide roller 19 of the limb 15*b* disengages completely from the semicircular guide 13*a*. As a result of the further movement of the roller carriages 7, 7' along the bent sections 8*b*, the angular levers 15, 15' are swung exclusively only by the movement of the door leaves 1, 1', into a position in which the center axis x of the limb 15*a* extends virtually at right angles to the longitudinal axis of the vehicle. If necessary, the angular levers 15, 15' can be locked in this position, as shown above, the locking being released again during the closing process of the door leaves 1, 1'.

If the roller carriages 7 and 7' reach the straight section 8*a* of the roller guides 8, 8' during the further linear movement of the guide bushes 12, 12', the synchronous displacement of the door leaves 1, 1' into a position which extends parallel to the outer wall of the vehicle starts. In the process, the door leaves 1, 1' are guided at the top, by the limb 15*a* of the angular levers 15, 15' which engages on the guide rails 3, 3', and at the bottom by means of the pivoted levers 20 which bear with their guide rollers 21, 22 against the guide rails 4. These guides also contribute significantly to stabilizing the door leaves during their longitudinal displacement.

Figure 5:
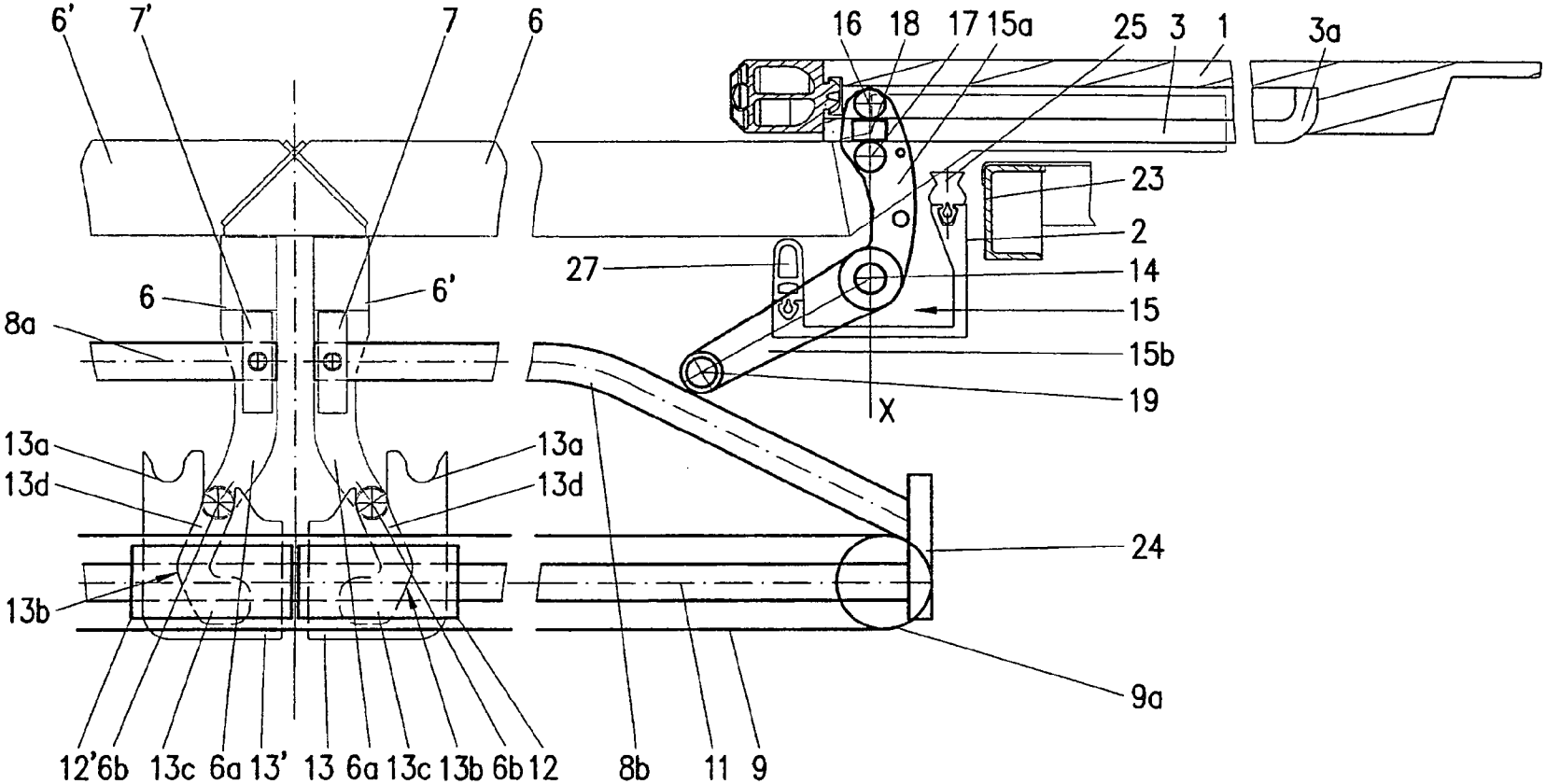
FIG. 5 shows the detail "Y" according to FIG. 2 in an enlarged view.

The guide bushes 12, 12' which are guided on the guide rod 11 and which have the control elements 13, 13' move in the opposite direction, and the linear movement is transmitted to the guide arm 6' via the control element 13, and the door leaf 1' is displaced. In an analogous fashion, the door leaf 1 is moved by means of the control element 13', and the guide arms 6, 6' are arranged so as to cross over one another. Directly before the two linearly moved guide bushes 12, 12' meet, the two door leaves 1, 1' are in the ultimate open position, as shown in FIGS. 2 and 5.

By triggering the instruction "close door", the guide bushes 12, 12' are moved in the opposite direction, in each case outward (phase II). The guide arms 6, 6' which are attached to the door leaves 1, 1' are connected on the one hand to the roller carriages 7, 7' and on the other hand to the control plates 13, 13' via the guide rollers 6*b* which engage with the curved paths 13*d*. The roller carriages 7, 7' are moved along the straight sections 8*a* of the roller guides 8, 8' and as a result the door leaves 1, 1' are moved in the closing direction, during which process they assume a slightly oblique position. In this position, there is still a distance or free space between the adjacent finger protection strips 27, 27' of the door leaves 1, 1'. After the curved sections 8*b* of the roller guides 8, 8' have been reached, the door leaves 1, 1' are moved in the transverse direction.

In the process, the guide rollers 6*b* which are attached to the guide arms 6, 6' move along the curved path 13*d* in the direction of the enlarged section 13*c* of the recess 13*b* of the control plates 13, 13'. Just before the enlarged section 13*c* is reached, the guide rollers 19*a* which are attached to the limbs 15*b* of the angular levers 15, 15' move again into the engagement region of the semicircular guides 13*a*. What is referred to as a "flying transfer" (from phase II to phase I) takes place again and the guide rollers 6*b* of the guide arms 6 and 6' move into the enlarged section 13*c* of the recess 13*b*, and the guide arms 6, 6' thus disengage from, and cease to be affected by, the control plates 13 and 13', and the limb 15*b* with the guide roller 19 engages completely with the semicircular guide 13*a*. During the further linear movement of the guide bushes 12, 12' in the direction of the end stops 24, 24', the angular levers 15 and 15' are pivoted about their axes of rotation in the opposite direction owing to the engagement of the guide rollers 19 in the semicircular guides 13*a*, and as a result the door leaves 1, 1' are pulled into the locking edges 23 of the door frame 2 and pressed firmly against the door seals 25.

The movement sequences, displacement and pulling in of the door leaves 1, 1' are matched to one another in such a way that when the closing movement ends, the two door leaves 1, 1' abut one another with their adjacent sides along the longitudinal sides in the region of the flexible finger protection strips 27, 27', and in the process the longitudinal sides of the door leaves 1, 1' lying opposite assume the locked position and are pressed firmly against the door seals 25, 25'. In addition, finger protection profiles 26, 26' are also provided.

Figures 11, 12, 13:
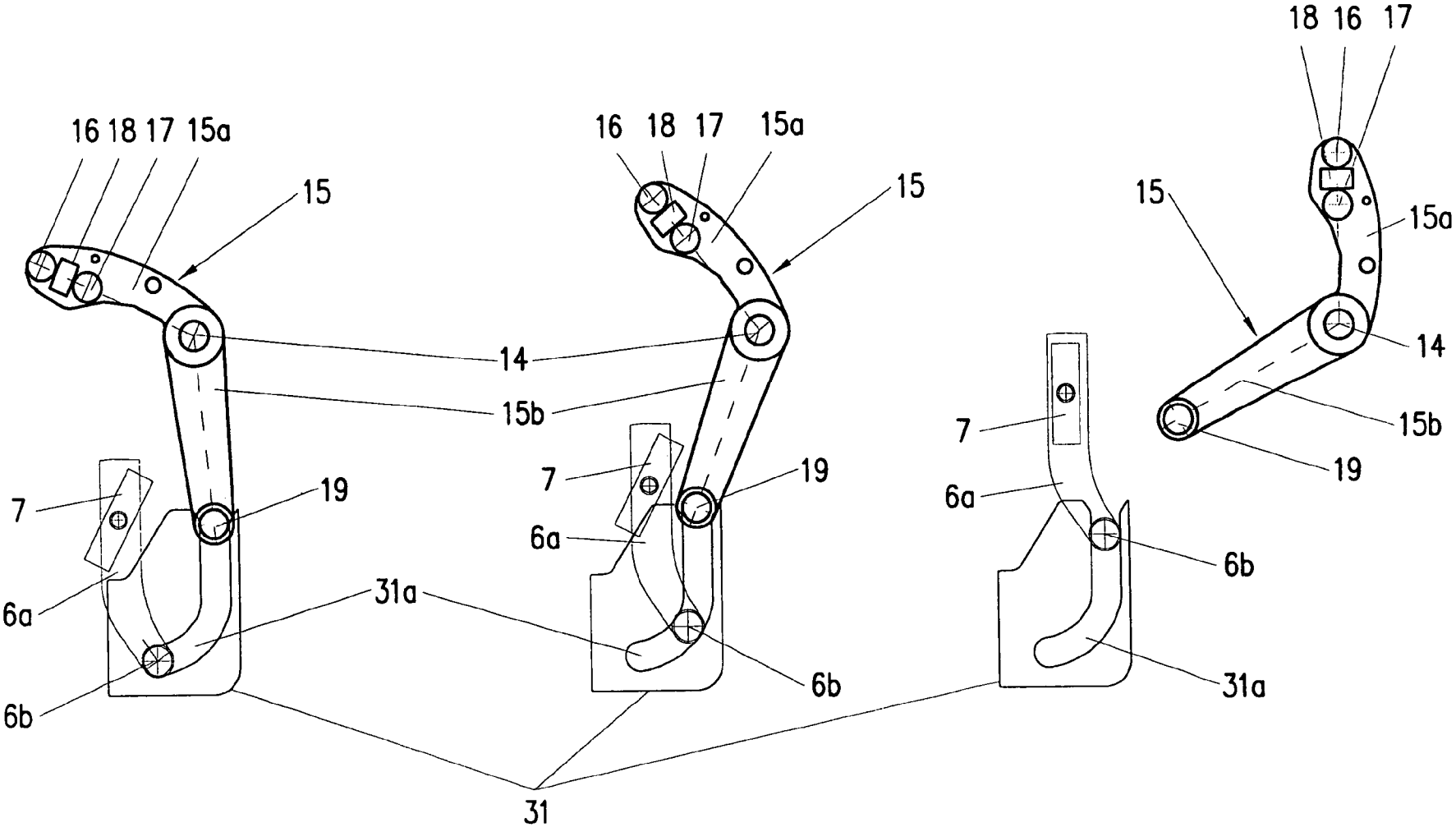
FIG. 11 shows a further embodiment variant of the control plate in a simplified plan view, with the door leaves in the closed state.
FIG. 12 shows the embodiment variant according to FIG. 11 with door leaves which are partially opened in the "transfer position.
" and FIG. 13 shows the embodiment variant according to FIG. 11 in the opened state of the door leaves.

A further embodiment variant for the control element arranged on the guide units 12, 12' is also shown in FIGS. 11 to 13. The movement sequence which is shown in these FIGS. is analogous to that according to FIGS. 3 to 5. The control element 31 differs from the control elements 13, 13' described above only in that, instead of the semicircular opening 13*a* and the recess 13*b*, only one guide 31*a* is provided, and it is embodied as a fork-shaped opening which is bent in the shape of an L. The guide roller 19 which is arranged on the limb 15*b* engages temporarily in said opening, and the guide roller 6*b* which is arranged on the guide arm 6, 6', 6*a* engages continuously in it. FIG. 11 shows the engagement of the guide rollers 19 and 6*b* during the closed state of the door leaf. The guide roller 6*b* which is arranged on the guide arm 6', 6*a* is located at the rear end of the guide 31*a* and is mounted in it in a floating fashion. An operative connection with the control plate 31 has not yet come about at this time. In contrast to this, the limb 15*b* of the angular lever 15 engages with, and is operatively connected to, the control plate 31 via the guide roller 19, and bears against the front end of the guide 31*a*. At the start of the opening movement for the door leaves 1, 1' in the transverse direction (phase I)—the roller carriage 7 moves along the bent section 8*b* of the roller guide 8—the angular lever 15 is swung in the clockwise direction and as a result the door leaf 1' is pressed out of the door opening. In the process, the guide arm 6 is moved, with the guide roller 6*b*, along the guide path 31*a* without application of force to the control plate 31. After the position shown in FIG. 12 has been reached, phase I is ended and phase II starts, and the limb 15*b* of the angular lever 15 now disengages from the guide path 31*a*, and the guide roller 6*b* of the guide arm 6' reaches the section of the guide path 31*a*, which section ensures the positively and frictionally locking connection, thus bringing about the operative connection to the control plate 31. The further opening movement of the door leaves (phase II) then takes place exclusively via this connection or coupling, the guide roller 6*b* of the guide arm 6' being moved further along the guide 31*a*. FIG. 13 shows, in a simplified fashion, the movement state after the complete opening of the door leaves has taken place, in a way which is analogous to FIG. 5. During the closing movement of the door leaves the movement takes place in reverse order.

Owing to the measures proposed according to the invention, the closing movement of the door leaves 1, 1' takes place with controlled kinematics and a small amount of kinetic energy, as a result of which a particularly high level of protection against pinching injuries is provided. The gentle closing movement of the door leaves 1, 1' reliably prevents undesired pinching since the reversing movement of the door leaves is triggered immediately even in the case of slight contact.

Apart from the gentle closing movement, reliable closing of the door leaves is also brought about. The closing movement presses the door leaves, in their end position, against the door seals 25, 25' on the frame in a seal-forming fashion (FIGS. 1 and 3). A further advantage is that the locking mechanism for the door leaves can be made simpler and more cost effective since the door leaves bear firmly against the door seals as a result of the angular levers, for kinematic reasons after the end of the closing process.

The two-wing swinging sliding door is suitable, for example, for use in trams or short-distance train services. In conjunction with an emergency unlocking means, the door leaves can also easily be opened manually when necessary. By applying an appropriate movement force to the door leaves in the longitudinal direction, a swinging movement of the door leaves is brought about and the door leaves are pressed out of the closed position in the transverse direction and can then be displaced further in the longitudinal direction.

This application claims the priority, under 35 U.S.C. § 119, of European patent application No. 04 008 686.0, filed Apr. 10, 2004; the entire disclosure of the prior application is herewith incorporated by reference.

We claim:

1. A swinging and sliding door assembly for a rail vehicle, comprising:

a guide stationarily mounted to the rail vehicle, said guide having a straight section and an inwardly curved section curved in a direction toward a door frame of the rail vehicle;

at least one door leaf horizontally guided in an upper region thereof by said guide;

a guide arm attached to said door leaf and operatively connected to said guide;

a guide rail disposed on said door leaf and means coupled to said guide rail for swinging said door leaf relative to the rail vehicle;

a drive for moving said door leaf into a position extending parallel to an outer wall of the vehicle, said drive including a guide unit which engages with said guide arm;

said means for swinging said door leaf include an angular lever for guiding and moving said door leaf, said angular lever being rotatably mounted in a substantially horizontal plane in an immediate vicinity of said door frame, said angular lever having a first limb connected with said guide rail of said door leaf, and a second limb temporarily engaging with, and selectively operatively connected to, a control element disposed on said guide unit for swinging said door leaf and said second limb disengaging from said control element after a defined swinging displacement of said door leaf; and wherein, for controlling a sliding movement of said door leaf, said guide arm is operatively connected to said control element, and during a closing movement of said door leaf, said second limb of said angular lever selectively engages with, and selectively connects operatively to, said control element for swinging said door leaf into a closed position wherein said angular lever assumes a home position and thereby firmly presses said door leaf against a door seal and locks said door leaf.

2. The swinging and sliding door assembly according to claim 1, wherein said control element is a plate-shaped component that has an L-shaped guide which engages with said guide arm and said second limb of said angular lever, wherein said guide arm is displaceably mounted in said L-shaped guide while said second limb and said control element are operatively connected.

3. The swinging and sliding door assembly according to claim 1, wherein said control element is a plate-shaped component which includes a semicircular opening in which said second limb of said angular lever selectively engages, and a recess in which said guide arm selectively engages.

4. The swinging and sliding door assembly according to claim 3, wherein said recess has an enlarged section and an adjoining curved path wherein said guide arm is displaceably mounted within the enlarged section when disposed with said enlarged section, and when disposed within said curved path, said guide arm is positively connected to said control element.

5. The swinging and sliding door assembly according to claim 1, wherein said guide unit is a guide bush, and said control element is attached to an underside of said guide unit.

6. The swinging and sliding door assembly according to claim 1, further comprising upwardly directed guide rollers each respectively disposed at a free end of said guide arm and at a free end of said second limb, said guide rollers adapted to project into openings formed in said control element.

7. The swinging and sliding door assembly according to claim 1, wherein said guide rail disposed on said door leaf has an outwardly curved section at an end thereof.

8. The swinging and sliding door assembly according to claim 1, wherein said first and second limbs of said angular lever define an angle of between 90° and 120°.

9. The swinging and sliding door assembly according to claim 1, wherein an end of said first limb of said angular lever has first and second guide rollers and a support roller, said first guide roller bearing against an inside of said guide rail and said second guide roller bearing against an outside of said guide rail.

10. The swinging and sliding door assembly according to claim 9, wherein said first and second guide rollers disposed on said first limb protrude upwardly and are mounted with substantially vertical axes of rotation.

11. The swinging and sliding door assembly according to claim 9, wherein said support roller bears against an underside of said guide rail and is disposed between said first and second guide rollers.

12. The swinging and sliding door assembly according to claim 9, wherein said guide rollers are disposed adjacent a curved section of said guide rail during swinging of said door leaf.

13. The swinging and sliding door assembly according to claim 1, which comprises a further guide rail mounted at a lower region of said door leaf, said further guide rail having an outwardly curved section at an end thereof and being connected via guide rollers to a pivoted lever mounted on a common axis with said angular lever, and wherein said angular lever and said pivoted lever are connected to one another via a rotary column.

14. The swinging and sliding door assembly according to claim 1, wherein said angular lever is lockable after swinging into a position in which a center axis of said first limb extends substantially orthogonally to a longitudinal axis of the vehicle.

15. The swinging and sliding door assembly according to claim 14, further comprising a spring-loaded, two-armed locking lever rotatably mounted on said first limb of said angular lever, said locking lever moving into contact with a stationary stop during an opening movement of said door leaf thereby locking said angular lever, and wherein, during said closing movement of said door leaf, a driver disposed on said door leaf engages and rotates said locking lever thereby unlocking said angular lever.

16. The swinging and sliding door assembly according to claim 1, wherein said at least one door leaf comprises a right-hand door leaf having a left-hand guide arm and a left-hand door leaf having a right-hand guide arm, and wherein said guide unit comprises a right-hand guide unit and a left-hand guide unit movably disposed on a common linear guide, and wherein the assembly further comprises a right-hand roller carriage and a left-hand roller carriage, and said guide arms are arranged so as to pass over one another, wherein, during opposing movements of said door leaves, said right-hand door leaf is connected to, and engages with, said left-hand roller carriage and said left-hand guide unit via said left-hand guide arm, and said left-hand door leaf is connected to, and engages with, said right-hand roller carriage and said right-hand guide unit via said right-hand guide arm.

17. The swinging and sliding door assembly according to claim 1, wherein said door assembly comprises in a prefabricated door module having a plurality of attachment receptacles for attaching said door module to said rail vehicle.

* * * * *